US012420171B2

(12) United States Patent
Aoki

(10) Patent No.: US 12,420,171 B2
(45) Date of Patent: Sep. 23, 2025

(54) DICE ROLLING DEVICE

(71) Applicant: ENSKY CO., LTD., Saitama (JP)

(72) Inventor: Katsufumi Aoki, Saitama (JP)

(73) Assignee: ENSKY CO., LTD., Saitama (JP)

( * ) Notice: Subject to any disclaimer, the term of this patent is extended or adjusted under 35 U.S.C. 154(b) by 536 days.

(21) Appl. No.: 18/001,422

(22) PCT Filed: Oct. 26, 2020

(86) PCT No.: PCT/JP2020/040058
§ 371 (c)(1),
(2) Date: Dec. 9, 2022

(87) PCT Pub. No.: WO2021/255954
PCT Pub. Date: Dec. 23, 2021

(65) Prior Publication Data

US 2023/0201708 A1 Jun. 29, 2023

(30) Foreign Application Priority Data

Jun. 17, 2020 (JP) ..... 2020-002351

(51) Int. Cl.
*A63F 9/04* (2006.01)

(52) U.S. Cl.
CPC ..... *A63F 9/0406* (2013.01)

(58) Field of Classification Search
CPC ..... A63F 9/0406; A63F 2009/0408; A63F 2009/0411
See application file for complete search history.

(56) References Cited

U.S. PATENT DOCUMENTS 2,462,686 A * 2/1949 Stallard ..... A63F 9/0406 273/145 D
4,114,290 A * 9/1978 Cooper ..... G09B 19/02 273/145 CA (Continued)

FOREIGN PATENT DOCUMENTS

CN 206809730 U 12/2017
DE 4005668 A1 8/1990

(Continued)

OTHER PUBLICATIONS

International Preliminary Report on Patentability received for PCT Patent Application No. PCT/JP2020/040058, mailed on Dec. 29, 2022, 9 pages (5 pages of English Translation and 4 pages of Original Document).

(Continued)

*Primary Examiner* — Sean P Gramling
(74) *Attorney, Agent, or Firm* — WOMBLE BOND DICKINSON (US) LLP

(57) ABSTRACT

A dice rolling device (1) includes a housing (12) formed in a bottomed tubular shape that opens upward, and a plurality of pins {first and second pins (22, 24)} provided in the bottom portion of the housing (12). Further, the dice rolling device (1) includes a flat plate portion (8) with a plurality of through holes (9) through which the pins are inserted, and includes a dice stage (4) accommodated in the housing (12) movably in the vertical direction. The dice rolling device (1) further includes a spring member (31) that biases the dice stage (4) upward, a dome-shaped cover (2) that covers the flat plate portion (8) from above, and a die accommodated in a space (S1) surrounded by the cover (2) and the dice stage (4). The moving range of the dice stage (4) is the range between the lower limit position in which the pins (22, 24) extend through the through holes (9) and protrude above the (Continued)

flat plate portion (8) and the upper limit position in which the pins are accommodated in the through holes (9).

Hence, this invention can provide the dice rolling device (1) having high contingency of appearing dots of a die.

4 Claims, 10 Drawing Sheets

(56) References Cited

U.S. PATENT DOCUMENTS

| | | | | |
|---|---|---|---|---|
| 5,014,989 | A | 5/1991 | Urrestarazu Borda | |
| 5,100,141 | A | 3/1992 | Fitch | |
| 7,780,166 | B1 * | 8/2010 | Paxton | A63F 9/0406 273/145 C |
| 10,960,294 | B1 * | 3/2021 | Bartee | A63F 9/181 |
| 2013/0122983 | A1 | 5/2013 | Nicely et al. | |

FOREIGN PATENT DOCUMENTS

| | | | | | |
|---|---|---|---|---|---|
| JP | 60-073584 | U | | 5/1985 | |
| JP | 2003-265855 | A | | 9/2003 | |
| JP | 2015-229019 | A | | 12/2015 | |
| KR | 20-2019-0002496 | U | | 10/2019 | |
| KR | 20190002496 | U | * | 10/2019 | A63F 9/0406 |

OTHER PUBLICATIONS

International Search Report and Written Opinion received for PCT Patent Application No. PCT/JP2020/040058, mailed on Dec. 22, 2020, 11 pages (5 pages of English Translation and 6 pages of Original Document).

Extended European Search Report received for European Application No. 20940748.5, mailed on May 14, 2024, 5 pages.

Office Action received for Korean Patent Application No. 10-2022-7043867, mailed on Feb. 5, 2025, 9 pages (5 pages of English Translation and 4 pages of Office Action).

* cited by examiner

DICE ROLLING DEVICE

TECHNICAL FIELD

The present invention relates to a dice rolling device used to roll a die in a certain place.

BACKGROUND ART

An example of a conventional dice rolling device is described in patent literature 1. The dice rolling device disclosed in patent literature 1 employs an arrangement in which a box body accommodating a die is caused to jump up instantaneously. In this dice rolling device, when the box body rapidly rises and stops, the die jumps up and rolls in the box body, so that appearing dots of the die can be changed.

RELATED ART LITERATURE

Patent Literature

Patent Literature 1: Japanese Utility Model Laid-Open No. 60-73584

Disclosure of Invention

Problem to be Solved by the Invention

In the dice rolling device described in patent literature 1, since the die is rapidly pushed up and jumps up from a state of being placed on the bottom surface of the box body, appearing dots of the die cannot be changed by actively rolling the die. Therefore, an improvement in contingency of appearing dots of the die is limited.

It is an object of the present invention to provide a dice rolling device having high contingency of appearing dots of a die.

Means of Solution to the Problem

A dice rolling device according to the present invention comprises a housing formed in a bottomed tubular shape that opens upward, a plurality of pins provided in a bottom portion of the housing and protruding upward, a dice stage including a flat plate portion with a plurality of through holes through which the pins are inserted, and accommodated in the housing movably in a vertical direction in a predetermined moving range, a spring member provided between the bottom portion of the housing and the dice stage, and configured to energize the dice stage upward, a cover made of a transparent material in a dome shape that covers the flat plate portion from above, and attached to the dice stage, and a die accommodated in a space surrounded by the cover and the dice stage, wherein the moving range of the dice stage is a range between a lower limit position in which the pins extend through the through holes and protrude above the flat plate portion and an upper limit position in which the pins are accommodated in the through holes.

Effect of the Invention

According to the present invention, since the pin pushes up and rolls a die when the cover is pushed against the housing, it is possible to provide a dice rolling device having high contingency of appearing dots of the die.

BEST MODE FOR CARRYING OUT THE INVENTION

An embodiment of a dice rolling device according to the present invention will be described below in detail with reference to FIGS. 1A to 10.

Figure 1A:
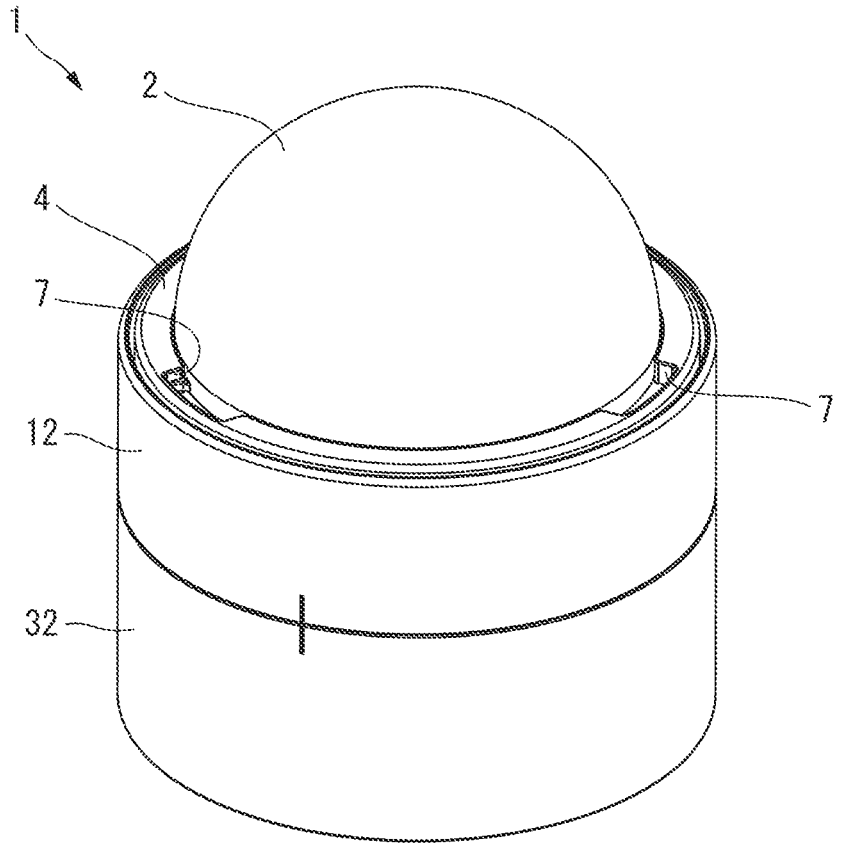
FIG. 1A is a perspective view of a dice rolling device according to the present invention.
Figure 1B:
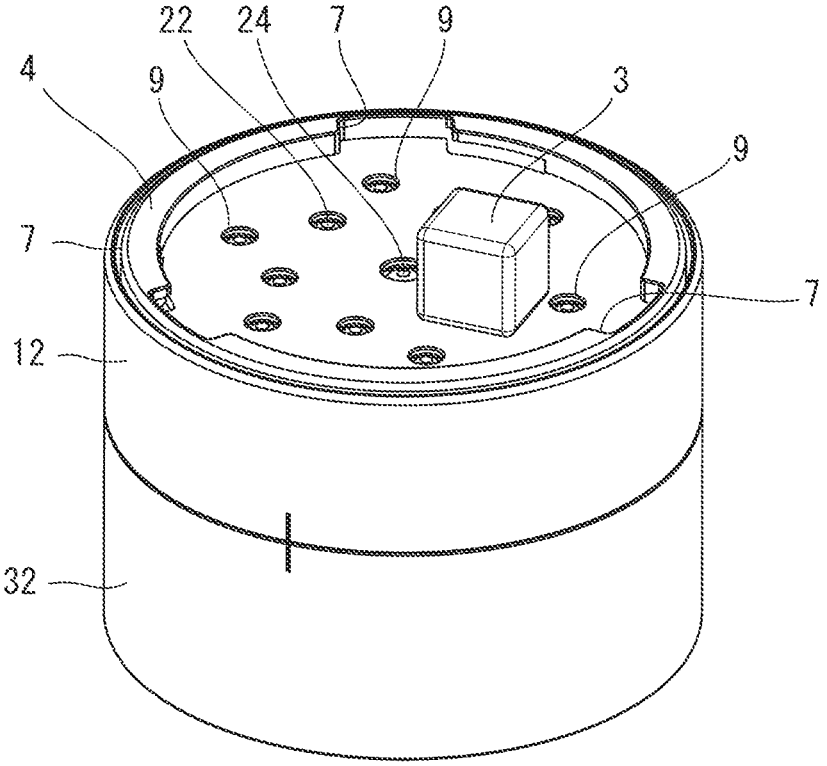
FIG. 1B is a perspective view of the dice rolling device according to the present invention.

A dice rolling device 1 shown in FIG. 1A is a device that casts a die 3 (see FIG. 1B) by causing the die 3 to roll and jump up inside a transparent cover 2 illustrated on the top in FIG. 1A. FIG. 1A is a perspective view of the dice rolling device 1 in a state in which the cover 2 is attached, and FIG. 1B is a perspective view of the dice rolling device 1 in a state in which the cover 2 is removed. One die 3 is shown in FIG. 1B, but the number of dice 3 can be changed as needed. Note that the die 3 is shown without dots, but the dots of the die 3 may be one to six points, symbols, or numbers on the respective faces.

The cover 2 is made of a transparent plastic material, and formed in a dome shape, in other words, a hollow semi-spherical shape. The cover 2 is detachably attached to the upper end portion of a dice stage 4. As shown in each of FIGS. 2 and 3, latch pieces 5 project at positions that divide the lower end portion of the cover 2 into three equal parts in the circumferential direction.

Figure 4:
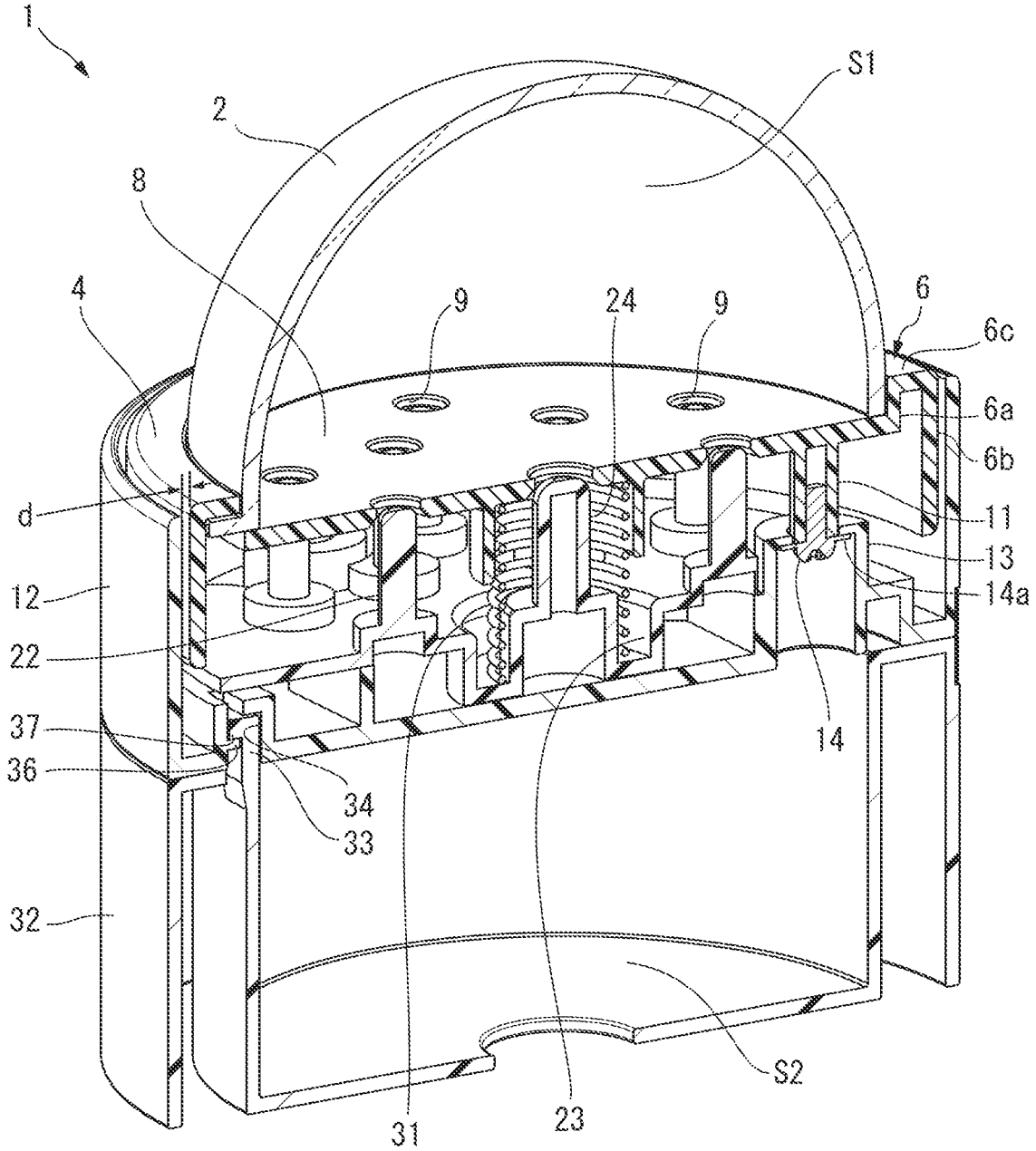
FIG. 4 is a sectional view of the dice rolling device when viewed from obliquely above.
Figure 5:
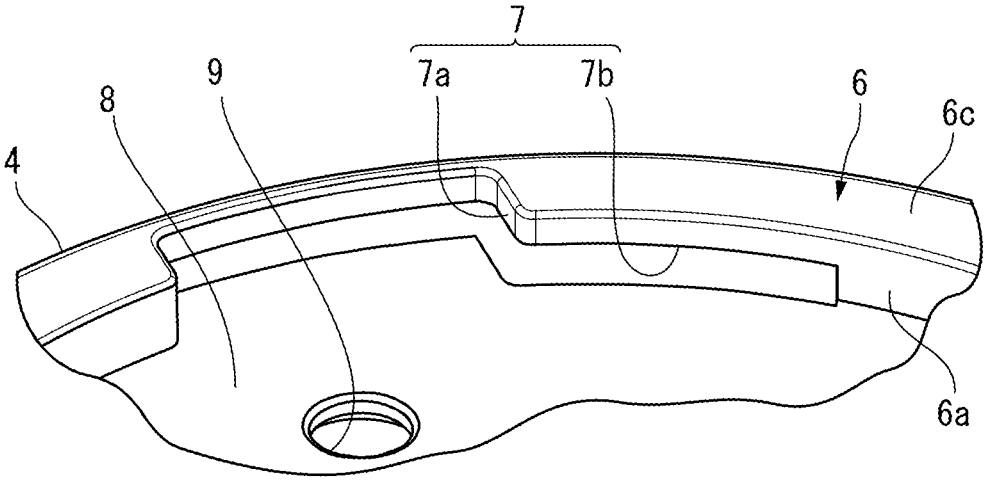
FIG. 5 is an enlarged perspective view of a part of a dice stage.

The dice stage 4 is formed in a bottomed cylindrical shape that opens downward. As shown in FIG. 4, an upper end portion 6 of the dice stage 4 has a double-walled structure including two cylindrical portions 6*a* and 6*b* having different diameters, and a ring portion 6*c* connecting the upper ends of the cylindrical portions 6*a* and 6*b*. The cutting position in FIG. 4 is the position indicated by a line IV-IV in FIG. 8.

Of the two cylindrical portions 6*a* and 6*b*, the inner diameter of the inner cylindrical portion 6*a* is a diameter that allows the outer peripheral portion at the lower end of the cover 2 to be fitted. In each of the inner cylindrical portion 6*a* and the ring portion 6*c*, notches 7 (see FIG. 5) where the latch pieces 5 of the cover 2 are inserted are formed. Each notch 7 extends in the circumferential direction of the dice stage 4, and includes an entrance/exit portion 7*a* through which the latch piece 5 can pass in the vertical direction, and a latching portion 7*b* where the latch piece 5 can move in the circumferential direction of the dice stage 4. In order to fix the cover 2 to the dice stage 4, first, the latch pieces 5 are inserted into the entrance/exit portions 7*a* from above. Then, the cover 2 is rotated in the circumferential direction with respect to the dice stage 4 to insert the latch pieces 5 into the latching portions 7*b*. By moving the latch pieces 5 into the latching portions 7*b* as described above, the cover 2 is fixed to the dice stage 4. The cover 2 can be removed from the dice stage 4 by a reverse operation of the above-described operation.

A disc-shaped flat plate portion 8 is provided on the inner side of the inner cylindrical portion 6*a* in the radial direction in the upper end portion of the dice stage 4. The flat plate portion 8 is a portion where the die 3 rolls and jumps up, and covered by the cover 2 from above. The die 3 is accommodated in a space S1 (see FIG. 4) surrounded by the cover 2 and the dice stage 4. A plurality of through holes 9 are formed in the flat plate portion 8 as shown in FIG. 1B. The opening shape of each through hole 9 is circular when viewed from above.

Figure 3:
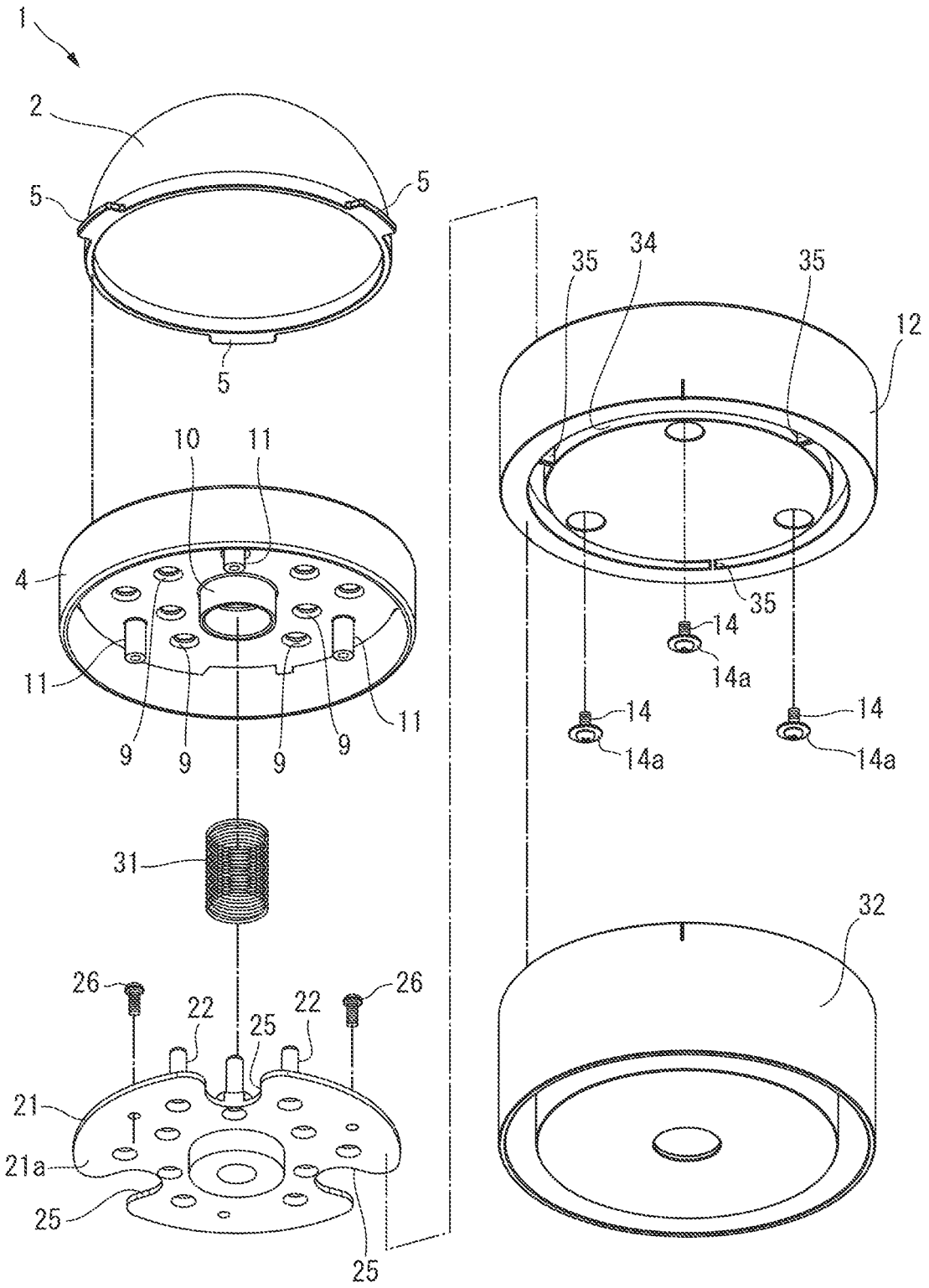
FIG. 3 is an exploded perspective view of the dice rolling device when viewed from obliquely below.

As shown in FIG. 3, a cylinder 10 projects from the central portion of the lower surface of the flat plate portion 8. In addition, three tubular shafts 11 project from the outer peripheral portion of the lower surface of the flat plate portion 8. These tubular shafts 11 are provided at positions that divide the flat plate portion 8 into three equal parts in the circumferential direction and, as shown in FIG. 4, the tubular shafts 11 are respectively inserted from above into tubular bodies 13 provided in a housing 12 to be described later. The tubular shaft 11 is inserted into the tubular body 13 in a loosely fitted state so that it can move slightly in the horizontal direction with respect to the tubular body 13.

Figure 6:
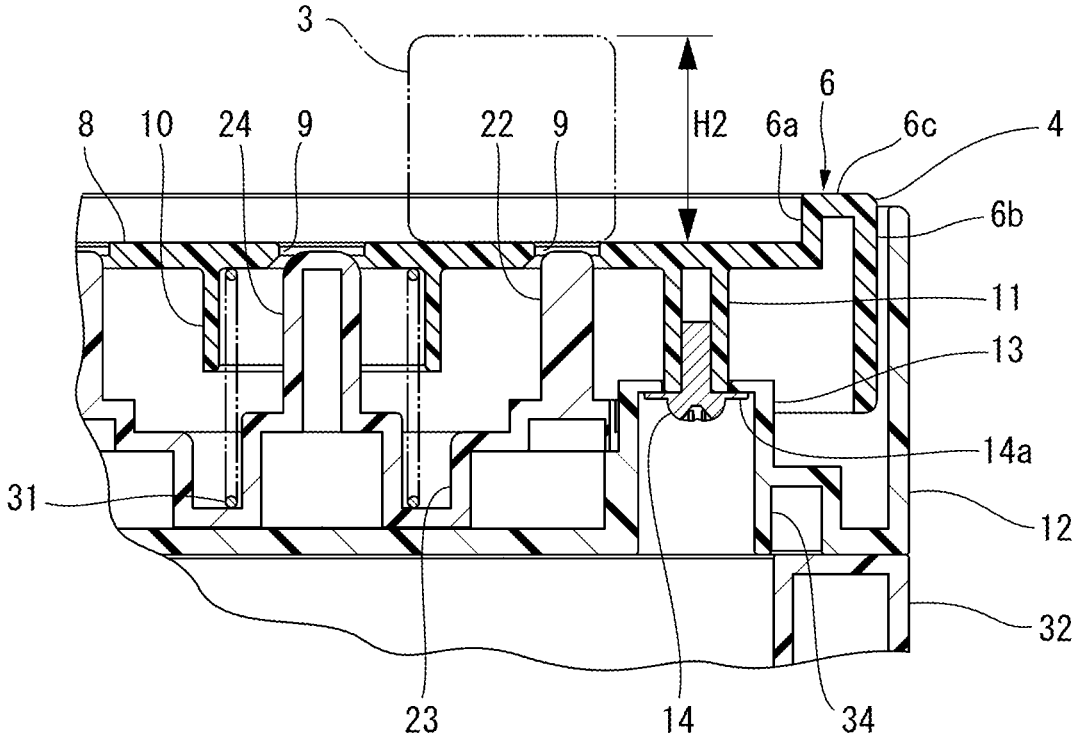
FIG. 6 is a sectional view showing the main part.
Figure 7:
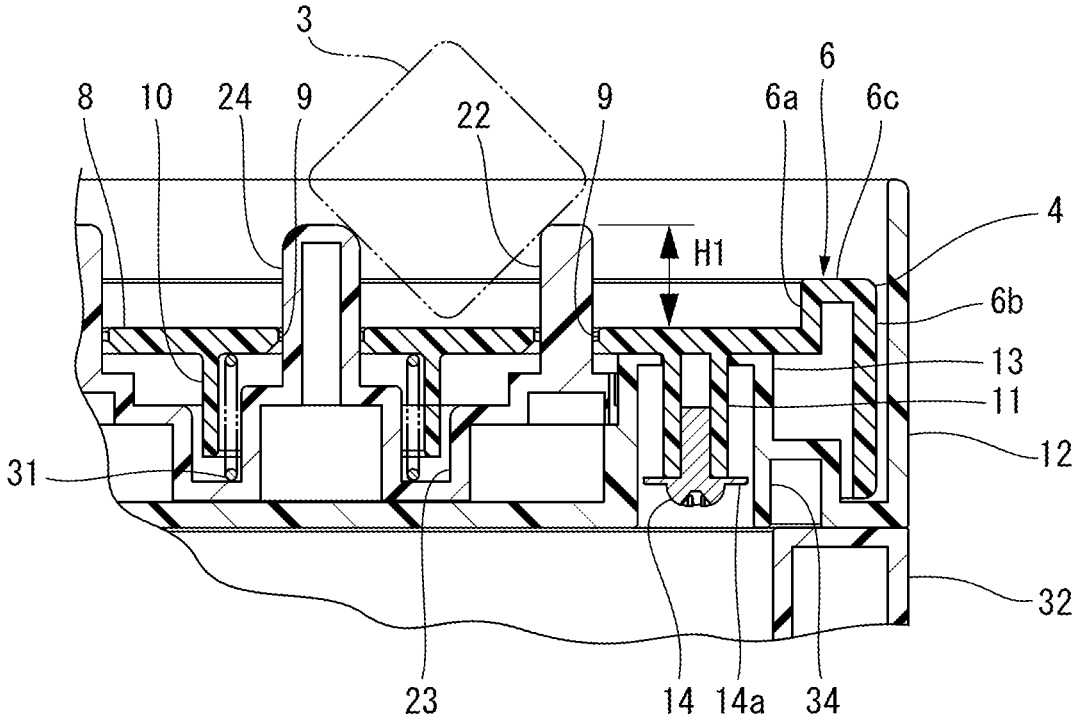
FIG. 7 is a sectional view showing the main part.

A screw member 14 is screwed into the distal end portion of the tubular shaft 11 shown in FIG. 4. The screw member 14 includes a plate 14*a* that faces the upper end portion of the tubular body 13 from below, and regulates the tubular shaft 11 from coming off from the tubular body 13 upward. Since the tubular shafts 11 are movably held by the tubular bodies 13 as described above, the dice stage 4 is supported by the housing 12 movably in the vertical direction. The dice stage 4 can move in the vertical direction with respect to the housing 12 in a moving range between the upper limit position in which the plate 14*a* of the screw member 14 abuts against the upper end portion of the tubular body 13 as shown in FIG. 6, and the lower limit position in which the flat plate portion 8 abuts against the upper end of the tubular body 13 as shown in FIG. 7. That is, the dice stage 4 is accommodated in the housing 12 movably in the vertical direction in a predetermined moving range.

Figure 2:
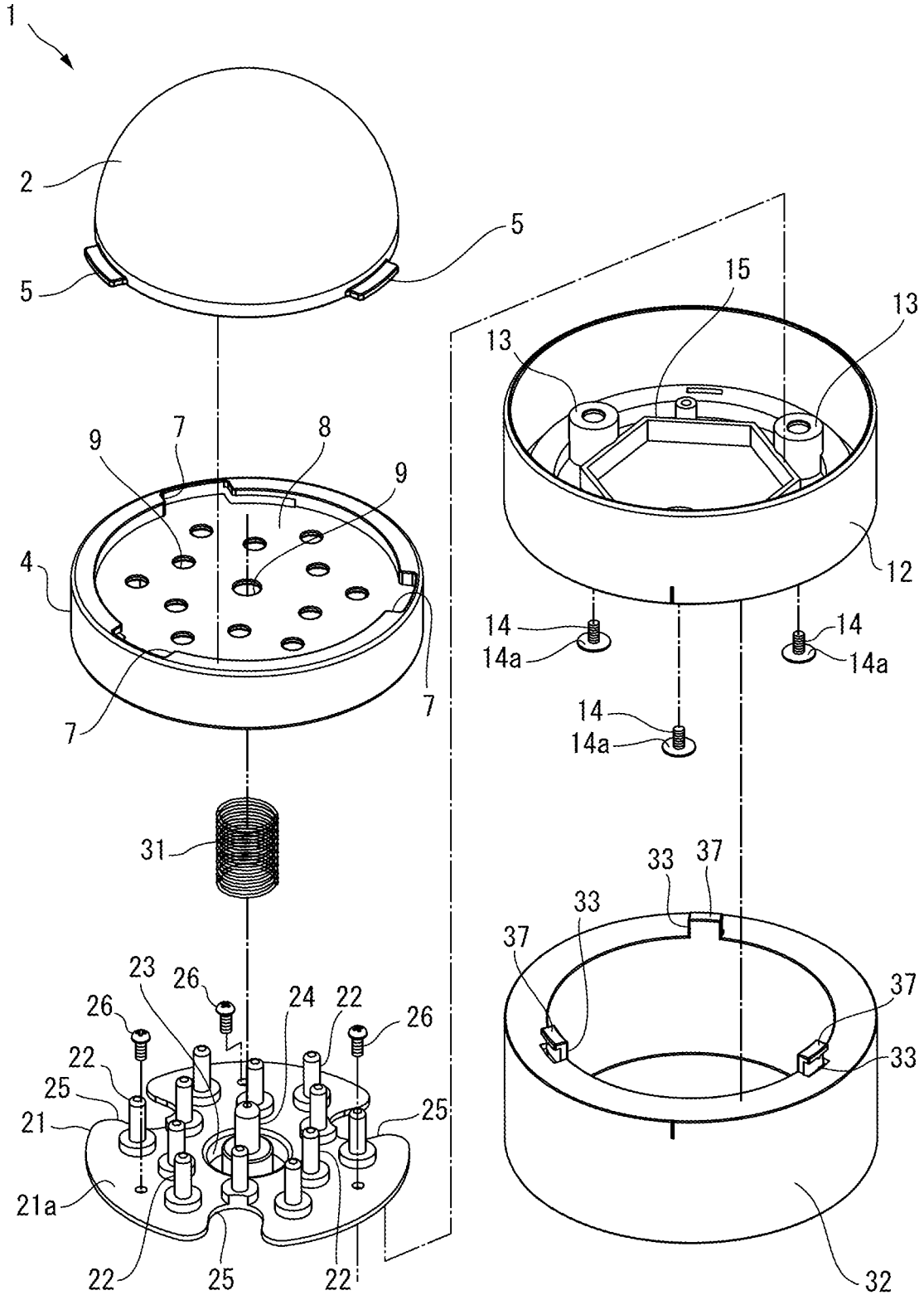
FIG. 2 is an exploded perspective view of the dice rolling device when viewed from obliquely above.

As shown in FIG. 2, the housing 12 is formed in a bottomed cylindrical shape that opens upward. The inner diameter of the housing 12 is larger than the outer diameter of the dice stage 4. Accordingly, a predetermined gap d (see FIG. 4) is formed between the inner circumferential surface of the housing 12 and the outer cylindrical portion 6*b* of the dice stage 4.

The above-described tubular bodies 13 project from the bottom portion of the housing 12. The tubular bodies 13 are provided at positions that divide the housing 12 into three equal parts in the circumferential direction so that each tubular body 13 corresponds to each tubular shaft 11. A support seat 15 having a hexagonal shape when viewed from above is provided in the range surrounded by the tubular bodies 13. The support seat 15 is used to place a plate-shaped portion 21*a* of a pin member 21 (to be described later) on the bottom portion of the housing 12.

As shown in FIGS. 2 and 3, the pin member 21 includes the plate-shaped portion 21*a* having a disk shape, a plurality of first pins 22 projecting on the plate-shaped portion 21*a*, an annular recess portion 23 that opens in the central portion of the plate-shaped portion 21*a*, and one second pin 24 projecting from the central portion of the annular recess portion 23. Each of the first and second pins 22 and 24 is formed in a circular shape when viewed from above. The second pin 24 is thicker than the first pin 22.

At positions in the outer peripheral portion of the plate-shaped portion 21*a* that divide the outer peripheral portion into three equal parts in the circumferential direction, notches 25 are formed to allow the tubular bodies 13 of the housing 12 to extend therethrough.

In a state of being placed on the bottom portion of the housing 12, the pin member 21 according to this embodiment is fixed to the housing 12 by a plurality of fixing screws 26 extending through the plate-shaped portion 21*a* in the vertical direction.

The first and second pins 22 and 24 are arranged such that, when the dice stage 4 moves from the upper limit position to the lower limit position described above, they extend through the through holes 9 of the dice stage 4 and protrude above the flat plate portion 8. Note that the hole diameter of the through hole 9 is larger than the outer diameter of each of the first and second pins 22 and 24 by a predetermined dimension so that each of the first and second pins 22 and 24 is inserted in a loosely fitted state. Since the second pin 24 is formed thicker than the first pin 22, the hole diameter of the through hole 9 into which the second pin 24 is inserted is formed larger than the hole diameters of the other through holes 9.

As shown in FIG. 7, each of the first and second pins 22 and 24 has a length with which it protrudes above the flat plate portion 8 by a height H1 in a state in which the dice stage 4 is located at the lower limit position. In this embodiment, the height H1 is about ½ of a total height H2 (see FIG. 6) of the die 3. As shown in FIG. 6, in the state in which the dice stage 4 is located at the upper limit position, the first and second pins 22 and 24 are accommodated in the through holes 9.

Figure 8:
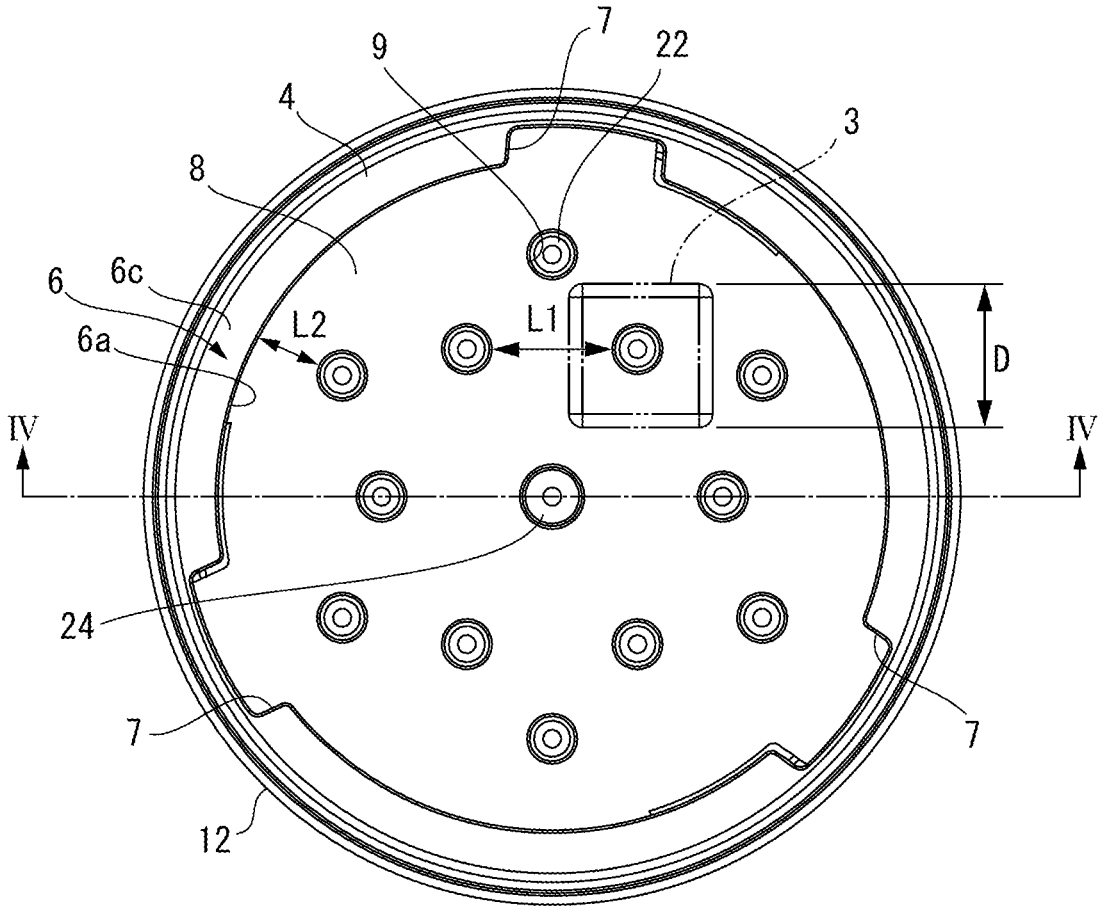
FIG. 8 is a plan view of the dice rolling device with a cover removed.

As shown in FIG. 8, the through holes 9 and the first and second pins 22 and 24 are arranged such that, when viewed from above, no empty space larger than the occupied area of the die 3 is generated on the flat plate portion 8 of the dice stage 4. That is, the first and second pins 22 and 24 are arranged such that a space L1 between the adjacent pins is smaller than a width D of the die 3. In addition, a spacing L2 between the first pin 22 located in the outer end portion of the flat plate portion 8 in the radial direction and the inner cylindrical portion 6*a* of the dice stage 4 is also smaller than the width D of the die 3. Accordingly, when the first and second pins 22 and 24 protrude from the flat plate portion 8, the die 3 is pushed up by at least one of the first and second pins 22 and 24 regardless of the position of the die 3 on the flat plate portion 8. At this time, the die 3 is pushed up while tilting, except in a rare case in which a single pin pushes up the die 3 from immediately below the center of gravity.

As shown in FIG. 4, the lower end portion of a spring member 31 formed by a compression coil spring is inserted into the annular recess portion 23 in the central portion of the pin member 21. The upper end portion of the spring member 31 is accommodated in the cylinder 10 of the dice stage 4. The spring member 31 is inserted between the bottom of the annular recess portion 23 and the lower surface of the flat plate portion 8 of the dice stage 4 in a compressed state. Accordingly, the dice stage 4 is biased upward by the spring force of the spring member 31 and held at the upper limit position. The upper limit position is a position where the plate 14*a* of the screw member 14 abuts against the tubular body 13 so that the upward movement is restricted.

A case 32 is detachably attached to the bottom portion of the housing 12. The case 32 is formed in a bottomed cylindrical shape that opens upward, and includes an accommodation space S2 where the die 3 and another item (not shown) can be accommodated. Here, the other item includes, for example, a bundle of cards (not shown) to be used in a dice game.

As shown in FIG. 2, a plurality of latch pieces 33, which are used to attach the case 32 to the housing 12, project from the upper end portion of the case 32. The latch pieces 33 protrude upward from the upper end portion of the case 32, and are formed to be insertable into an annular groove 34 (see FIG. 3) formed in the bottom of the housing 12.

Figure 9:
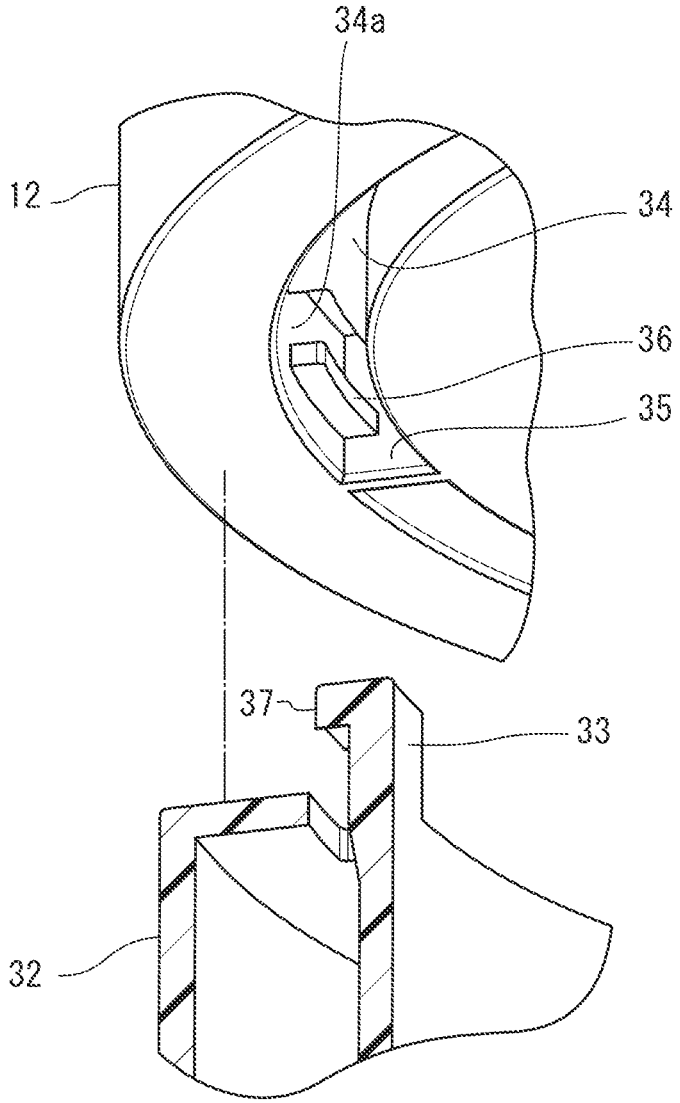
FIG. 9 is a perspective view showing the connection portion between a housing and a case.

As shown in FIG. 3, the inside of the annular groove 34 is divided into three parts by three partition plates 35. As shown in FIG. 9, a projection 36 extending in the circumferential direction is provided in a portion where a groove wall 34*a* of the annular groove 34 on the outer circumferential side contacts the partition plate 35. The latch piece 33 of the case 32 protrudes upward from the inner peripheral portion of the case 32. The upper end of the latch piece 33 is formed by a connecting plate 37 extending outward in the radial direction of the case 32. The connecting plate 37 is formed such that when, in a state in which the latch pieces 33 are inserted into the annular groove 34, the case 32 is rotated in the circumferential direction with respect to the housing 12 so that each latch piece 33 moves toward the partition plate 35, the connecting plate 37 overlaps the projection 36 while being placed on the projection 36. When the connecting plates 37 overlap the projections 36 as described above, the case 32 is fixed to the housing 12. In order to remove the case 32 from the housing 12, the case 32 is rotated with respect to the housing 12 in the opposite direction to the above-described direction so that the connecting plates 37 come off from the projections 36.

In order to use the dice rolling device 1 formed as described above, first, a user (not shown) pushes the cover 2 downward by hand. When the cover 2 is pushed downward, the dice stage 4 is lowered with respect to the housing 12 against the spring force of the spring member 31. At this time, the plurality of first pins 22 and the second pin 24 protrude above the flat plate portion 8, and the die 3 is pushed up by at least one of the first and second pins 22 and 24. When pushed up by the first pin 22 or the second pin 24, the die 3 loses balance and tilts.

When the user releases his/her hand from the cover 2, the dice stage 4 rapidly rises due to the spring force of the spring member 31, and suddenly stops when the screw members 14 abut against the tubular bodies 13. This operation including the rapid rise and sudden stop of the dice stage 4 causes the die 3 to roll and jump up on the flat plate portion 8. The die 3 is also caused to roll and jump up when the operation of pushing down the cover 2 is performed rapidly. When the posture of the die 3 is changed by rolling or jumping up, appearing dots of the die 3 can be changed.

Therefore, according to this embodiment, since the first pin 22 or the second pin 24 pushes up and rolls the die 3, it is possible to provide a dice rolling device having high contingency of appearing dots of the die 3.

The first and second pins 22 and 24 according to this embodiment are arranged such that the spacing L1 between the adjacent pins is smaller than the width D of the die 3. Accordingly, the die 3 can always be pushed by the first pin 22 or the second pin 24, so that the die 3 can be reliably rolled over. This further increases the contingency of appearing dots of the die 3.

Figure 10:
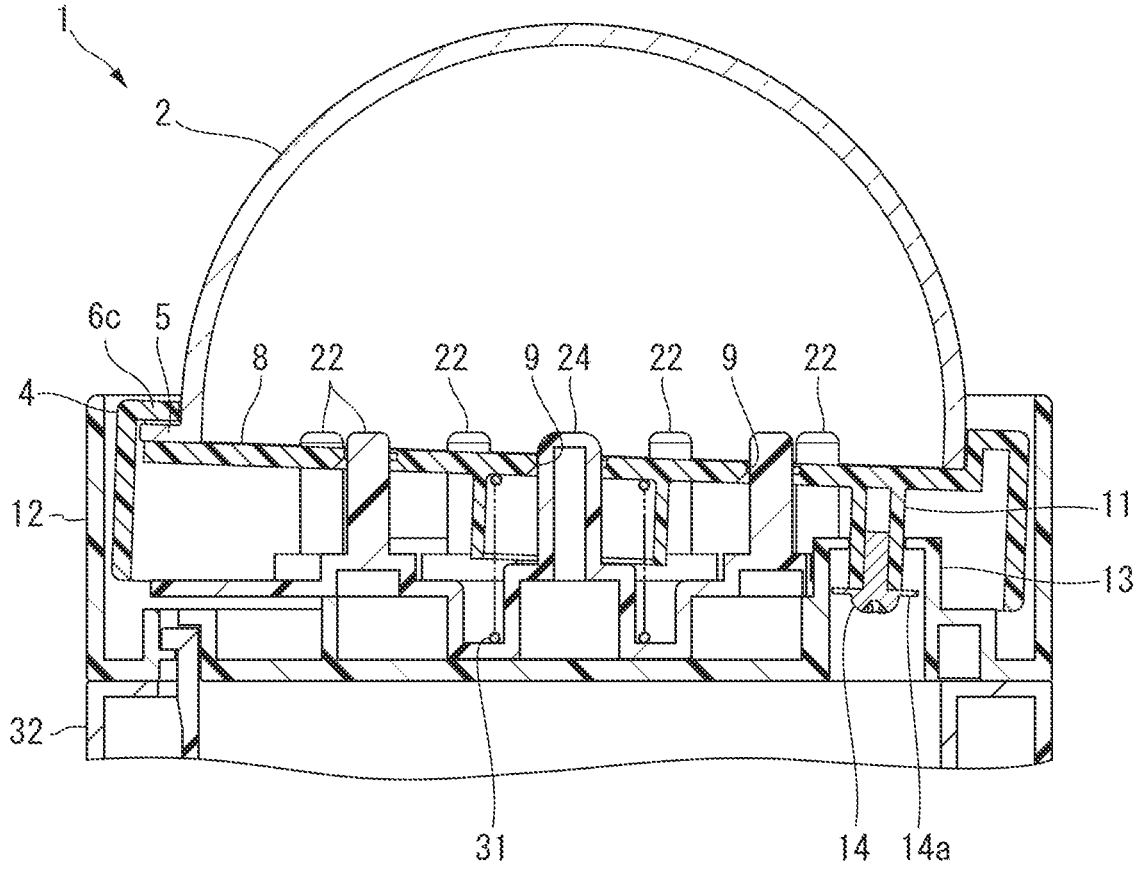
FIG. 10 is a sectional view of the dice rolling device.

Each through hole 9 according to this embodiment is formed so as to allow the first pin 22 or the second pin 24 to be inserted thereinto in a loosely fitted state. Each tubular body 13 of the housing 12 is formed so as to allow the tubular shaft 11 to be inserted thereinto in a loosely fitted state. By employing this arrangement, as shown in FIG. 10, the dice stage 4 can be tilted with respect to the housing 12 between the lower limit position and the upper limit position. The dice stage 4 shown in FIG. 10 is tilted downward to the right with respect to the housing 12. The cutting position in FIG. 10 is the position indicated by the line IV-IV in FIG. 8. When the dice stage 4 is tilted in this manner, the die 3 can be pushed obliquely and rolled. This further increases the contingency of appearing dots of the die 3.

The cover 2 according to this embodiment is detachably attached to the dice stage 4. Further, the case 32 which can accommodate the die 3 is detachably attached under the housing 12. Therefore, when the number of the dice 3 to be used is increased or decreased, it is possible to take the die 3 out of the case 32 and move it to the dice stage 4, or accommodate the excess die 3 on the dice stage 4 into the case 32. Accordingly, the number of the dice 3 to be used can be easily changed, and the unused die 3 would not be lost. In addition to the die 3 or in place of the die 3, for example, a bundle of cards (not shown) to be used in a dice game can be accommodated in the case 32. By accommodating the bundle of cards in the case 32 as described above, it becomes possible to carry the cards for a dice game together with the dice rolling device 1.

Explanation of the Reference Numerals and Signs

1 . . . dice rolling device, 2 . . . cover, 3 . . . die, 4 . . . dice stage, 8 . . . flat plate portion, 9 . . . through hole, 12 . . . housing, 22 . . . first pin, 24 . . . second pin, 31 . . . spring member, 32 . . . case

The invention claimed is:

1. A dice rolling device comprising:

a housing formed in a bottomed tubular shape that opens upward;

a plurality of pins provided in a bottom portion of the housing and protruding upward;

a dice stage including a flat plate portion with a plurality of through holes through which the pins are inserted, and accommodated in the housing movably in a vertical direction in a predetermined moving range;

a spring member provided between the bottom portion of the housing and the dice stage, and configured to energize the dice stage upward;

a cover made of a transparent material in a dome shape that covers the flat plate portion from above, and attached to the dice stage; and a die accommodated in a space surrounded by the cover and the dice stage, wherein the moving range of the dice stage is a range between a lower limit position in which the pins extend through the through holes and protrude above the flat plate portion and an upper limit position in which the pins are accommodated in the through holes.

2. The dice rolling device according to claim 1, wherein the plurality of pins are arranged such that a space between the adjacent pins is smaller than a width of the die.

3. The dice rolling device according to claim 1, wherein the dice stage is tiltable with respect to the housing between the lower limit position and the upper limit position.

4. The dice rolling device according to claim 1, wherein the cover is detachably attached to the dice stage, and a case that can accommodate the die is detachably attached under the housing.

* * * * *